US005311635A

United States Patent [19]

Moore

[11] Patent Number: 5,311,635

[45] Date of Patent: May 17, 1994

[54] SHOWER BATH AID

[76] Inventor: Gaylon L. Moore, P.O. Box 382, Odessa, Tex. 79760

[21] Appl. No.: 82,791

[22] Filed: Jun. 28, 1993

[51] Int. Cl.[5] ..... A47K 7/02

[52] U.S. Cl. ..... 15/244.3; 15/210.1; 15/244.1; 4/606; 601/136

[58] Field of Search ..... 15/160, 215, 217, 210.1, 15/244.1, 244.3; 4/606; 128/62 R, 65

[56] References Cited

U.S. PATENT DOCUMENTS

| | | | |
|---|---|---|---|
| 1,954,940 | 4/1934 | Mikel | 15/244.3 |
| 2,901,760 | 9/1959 | Nelson | 4/606 |
| 2,904,038 | 9/1959 | Hackney | 15/210.1 |
| 3,146,479 | 9/1964 | Stoker | 15/244.1 |
| 3,289,215 | 12/1966 | Kennedy | 15/210.1 |
| 3,750,226 | 8/1973 | Morgan | 15/210.1 |
| 4,020,519 | 5/1977 | Robison | 4/606 |
| 4,047,259 | 9/1977 | Lotis | 15/244.3 |
| 4,699,127 | 10/1987 | Schley | 128/65 |
| 4,704,759 | 11/1987 | Mesa | 4/606 |
| 4,890,352 | 1/1990 | Stowers et al. | 4/606 |

FOREIGN PATENT DOCUMENTS

| | | | |
|---|---|---|---|
| 2426432 | 12/1975 | Fed. Rep. of Germany | 4/606 |
| 563146 | 6/1975 | Switzerland | 15/210.1 |
| 2123281 | 2/1984 | United Kingdom | 15/160 |
| 2216000 | 10/1989 | United Kingdom | 15/210.1 |

*Primary Examiner*—Harvey C. Hornsby
*Assistant Examiner*—Mark Spisich

[57] ABSTRACT

A back cleaning apparatus which is adapted to be mounted in either a shower or bathtub. The apparatus includes suction cups for removably attaching it to the wall of a shower or bathtub. The cleaning surface comprises a sponge rubber member provided with a covering member such as indoor-outdoor carpet.

1 Claim, 3 Drawing Sheets

SHOWER BATH AID

BACKGROUND OF THE INVENTION

Since the inception of personal hygiene by the human race, one area of the human body has always been difficult to clean and bathe, the back. Because of the design and function of the human body, unless one is a contortionist, it is impossible to reach and bathe every area of the back--several attempts have been made at solving this age-old problem including; almost every conceivable type of hand-held back brush. But the problems with these types of bathing aids are, they must be hung on the shower head, the bathtub water outlet, or left laying on the top edge of the bathtub when not being used, in addition these types of bathing aids are usually made of a hard fragile material such as plastic and are subject to breaking when dropped, which in turn can be and is dangerous, other types of bathing aids are sponges and shower ropes, any and all of the present bathing aids must be washed and cleansed due to the fact they are dropped onto the floor or left in the bottom of the bathtub after use, and we are all aware of the danger that any kind of rope can be to a small child.

Therefore, it is the purpose of the present invention to provide a shower bath aid that is safe, and hygienically clean, which can be releasably attached to any shower wall or bathtub surface. The present invention being made from strong, lightweight and durable materials for long product life, at an economical cost.

OBJECTS OF THE INVENTION

It is an object of the present invention to provide a back scrubbing shower aid which can be releasably attached to a shower wall.

Another object of the present invention is to provide a back scrubbing shower aid which can be releasably attached to a bathtub.

Yet another object of the present invention is to provide a back scrubbing shower aid which does not require hand manipulation by the user.

A still further object of the present invention is to provide a shower bath aid which can be used as a head rest in a bathtub.

Yet a still further object of the present invention is to provide a shower bath aid which can be used as a back rest in a bathtub.

Another object of the present invention is to provide a shower bath aid which is safe to use.

A still further object of the present invention is to provide a shower bath aid which can be designed and manufactured in a variety of decorative shapes, sizes and colors.

BRIEF DESCRIPTION OF THE DRAWINGS

FIG. 1-A is a perspective cross section view of a shower bath aid.

DETAILED DESCRIPTION OF THE PREFERRED EMBODIMENTS

Figure 1:
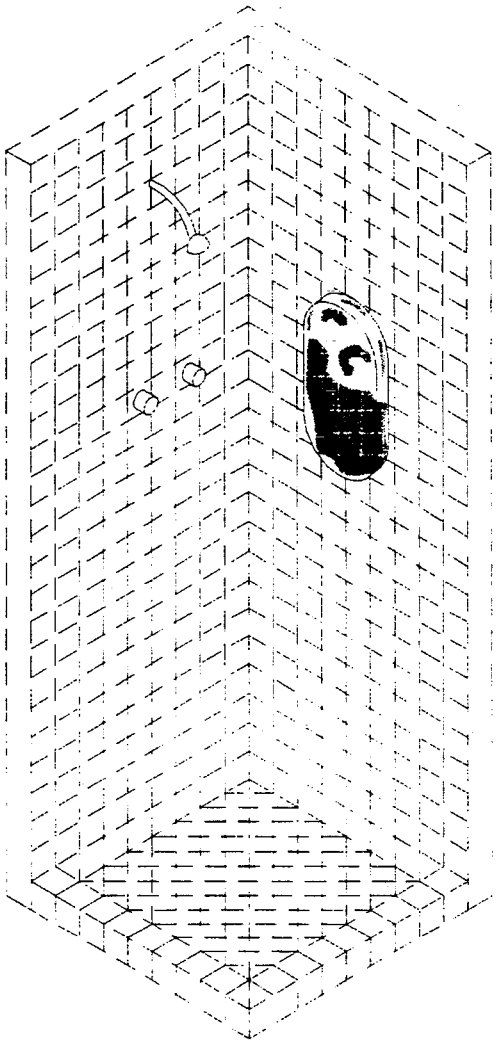
FIG. 1 is a perspective view of a shower bath aid device shown in its intended environment.
Figure 1A:
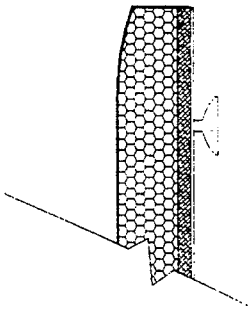

The shower bath aid of the subject invention is indicated generally by the numeral 12 in FIG. 1 shown in its intended environment releasably attached to shower wall 10. More particularly the shower bath aid cover 22 preferably is manufactured from soft firm flexible water resistant material that can be comfortably used for a reasonable period of time under a reasonably wide range of water temperature conditions. Additionally, it is preferred that the shower bath aid cover 22 be manufactured from durable and washable surfaced material to increase the life of the shower bath aid 12 and to ensure proper hygiene use throughout its life. For example, shower bath aid cover 22 could be manufactured from a variety of water resistant synthetic fabrics such as polyester, nylon, dacron and the like.

Due to the versatility of the shapes, sizes and materials in which the shower bath aid may be manufactured into and from, the following method of manufacture and materials are used for the purpose of explanation and example only, and is not intended to imply the only method of material or manufacture.

FIG. 1-A is a cut-away side view showing the different components of material used in the manufacture of shower bath aid 12. A suction cup 14 is shown attached by #6 pan head screws 24 (not shown) to the vinyl back 16 which in turn is attached by means of an industrial glue to backer board 18, a sponge rubber pad 20 is attached to backer board 18 by means of an industrial glue, this is then covered with a water resistant type material 22, such as an indoor-outdoor carpet.

Figure 2:
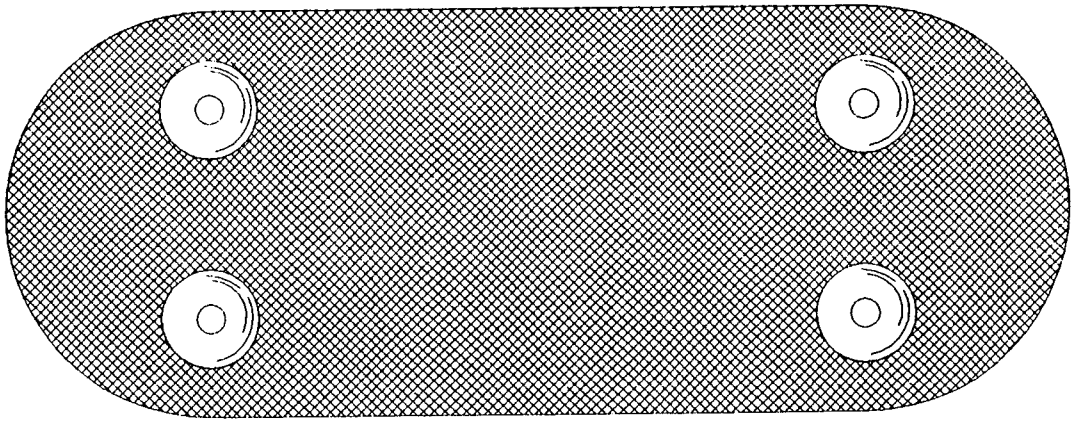
FIG. 2 is a plan bottom view thereof.

FIG. 2 shows the shower bath aid 12, with the vinyl back 16 exposed and suction cups 14 attached to vinyl back 16.

Figure 3:
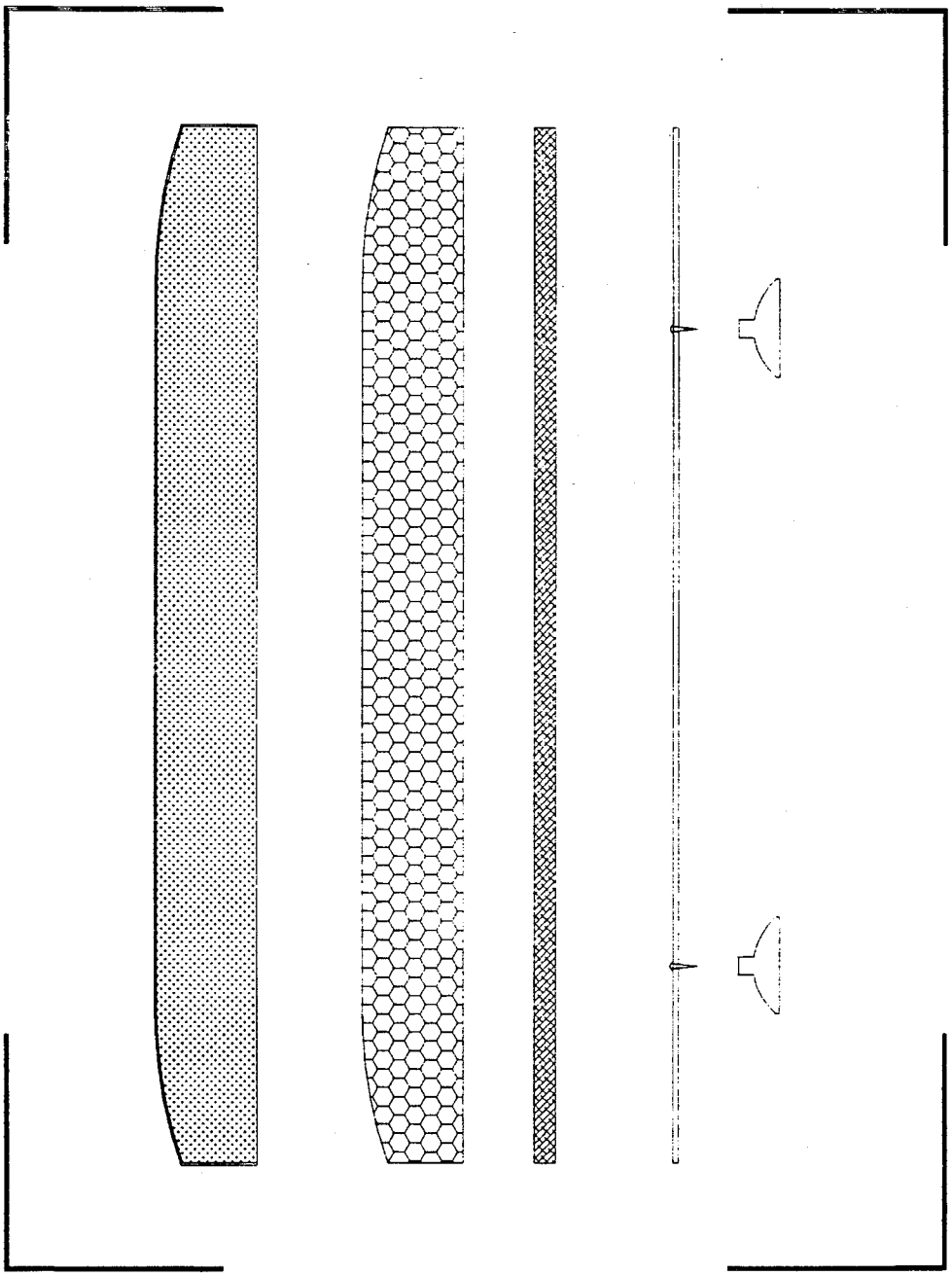
FIG. 3 is an exploded view thereof.

FIG. 3 is an exploded view of the shower bath aid 12. The vinyl back 16, backer board 18 and rubber sponge 20 are all cut to the same size, the indoor-outdoor carpet material 22 is cut approximately two inches larger overall. Starting with the vinyl back 16 small holes are drilled approximately two inches from each end and one inch from each outside. Four pan head screws are screwed into the predrilled holes from the inside to the outside. The vinyl back 16 with the pan head screws 24 is then glued or otherwise bonded onto the backer board 18, which is manufactured from a rigid type material such as plastic, fiberglass or plywood, the sponge rubber 20 is then glued or otherwise bonded to the backer board 18. The exterior cover of indoor-outdoor carpet 22 like material is then fitted snugly over the bonded components of 16, 18 and 20, layered onto the bottom outside of vinyl back 16 and glued, stitched, stapled or otherwise bonded onto vinyl back 16.

The suction cups 14 approximately one inch in diameter are then screwed onto pan head screws 24.

While the subject invention has been described and illustrated with respect to a preferred embodiment, it is understood that various changes and modifications can be made therein without departing from the spirit of the present invention which should be limited only by the scope of the appended claims.

REFERENCE NUMBERS LIST

10 Shower Stall
12 Shower Aid
14 Suction Cup
16 Vinyl Back
18 Backer Board
20 Sponge Rubber
22 Indoor-Outdoor Carpet
24 Pan Head Screws

I claim:

1. A back cleaning apparatus comprising:

a backer board comprising a substantially rigid sheet member having a first and second opposite sides;

a vinyl sheet attached to and coextensive with the first side of the backer board;

a plurality of suction cups outwardly extending from said vinyl sheet for selectively attaching said apparatus to a supporting surface;

a sponge rubber member attached to and coextensive with the second side of the backer board; and a covering material attached to and substantially covering said sponge rubber member.

* * * * *